US006832612B2

(12) United States Patent
Zhao et al.

(10) Patent No.: US 6,832,612 B2
(45) Date of Patent: Dec. 21, 2004

(54) CIGARETTE FILTER WITH SCAVENGING EFFECT ON FREE RADICALS IN CIGARETTE SMOKE AND ITS PREPARATION METHOD

(75) Inventors: Baolu Zhao, Beijing (CN); Peter Rohdewald, Münster (DE); Jingnong (Charles) Li, Beijing (CN)

(73) Assignee: Horphag Research (UK) Limited, London (GB)

( * ) Notice: Subject to any disclaimer, the term of this patent is extended or adjusted under 35 U.S.C. 154(b) by 0 days.

(21) Appl. No.: 09/963,041

(22) Filed: Sep. 25, 2001

(65) Prior Publication Data

US 2002/0074009 A1 Jun. 20, 2002

(30) Foreign Application Priority Data

Oct. 16, 2000 (CN) ..... 00130133 A

(51) Int. Cl.[7] ..... A24B 15/18; A24D 3/04

(52) U.S. Cl. ..... 131/334; 131/335; 131/331; 131/202

(58) Field of Search ..... 131/334, 342, 131/203, 202, 200, 201, 331, 335, 341, 360

(56) References Cited

U.S. PATENT DOCUMENTS 3,407,821 A * 10/1968 Sokoloff ..... 131/265
3,732,872 A * 5/1973 Lakritz ..... 131/133 R
4,124,033 A * 11/1978 Zizka et al. ..... 131/10.9
4,636,182 A 1/1987 Cho et al.
5,308,874 A * 5/1994 Sanchez et al. ..... 514/731
5,470,874 A 11/1995 Lerner
5,829,449 A 11/1998 Hersh et al.
6,164,288 A 12/2000 Lesser et al.
6,311,694 B1 * 11/2001 Nichols et al. ..... 131/187
6,470,894 B2 * 10/2002 Hersh et al. ..... 131/334

FOREIGN PATENT DOCUMENTS

JP 6-62824 * 3/1994
WO WO 01/28370 A 4/2001
WO WO0128370 4/2002

OTHER PUBLICATIONS

Yashurio Takahata, et al, "Third International Symposium on the Role of Soy in Preventing and Treating Chronic Disease", http://soyfoods.com/3rdSoySymp/D14.html; Mar. 1, 2000.*

Comprehensive Reviews in Food Science and Food Safety "Fermentations in World Food Processing" 2000 Institute of Food Technologists—vol. 1, 2002—Pp. 1–10.

* cited by examiner

*Primary Examiner*—Dionne A. Walls
(74) *Attorney, Agent, or Firm*—Mintz Levin Cohn Ferris Glovsky and Popeo, PC; Marvin S. Gittes

(57) ABSTRACT

A cigarette filter that has a scavenging effect on smoking induced gas phase free radicals. The filter ingredients are comprised of proanthocyanidins and include, but are not limited to, extracts of barks of pine tree, extracts of cones of cypress trees, extracts of grape seeds, and any combination thereof. Also, vitamin C and other known antioxidant ingredients may be added.

14 Claims, No Drawings

CIGARETTE FILTER WITH SCAVENGING EFFECT ON FREE RADICALS IN CIGARETTE SMOKE AND ITS PREPARATION METHOD

BACKGROUND OF THE INVENTION

Field of the Invention

This invention relates to an improved cigarette filter with a scavenging effect on gas phase free radicals in cigarette smoke. The invention uses filters that contain proanthocyanidins for scavenging the free radicals. The present invention is also directed to a method for producing an improved cigarette filter with scavenging effect on gas phase free radicals.

It is well accepted that lit cigarettes produce an enormous amount of free radicals, including gas phase and solid phase free radicals. The number of free radicals in the gas phase has been estimated to be $10^{15}$ per puff, which are primarily alkyl, alkoxyl, peroxyl and nitric oxide (NO.) free radicals. Inhaling the gas phase free radicals produced by cigarette smoke into a human body is known to produce toxicological and pathological changes that are deleterious to humans. The gas phase free radicals are widely known to be more harmful to the human body than are solid phase free radicals. In part, this is a result of the high energy levels, that is, the volatility of gas phase free radicals.

Cigarette combustion, in particular, involves a complex burning process which produces free radicals that exist in the smoke. Cigarette smoke is a complex mixture of more than 4,700 chemicals, including high concentrations of highly reactive free radicals which play a major role in the toxicity of the smoke. The free radicals attack cell constituents, either directly or indirectly, and are believed to be a factor in tobacco smoke related diseases. Many parts of the body may be adversely affected by the gas phase free radicals including the lungs, mouth, pharynx, esophagus, heart and circulatory systems, and various organs. Free radicals may change the molecular structures of cell proteins and lipids and cause breaks in DNA sequences that lead to mutations, thereby increasing the risks of developing various types of cancers.

Studies indicate that mainstream smoke, that is, smoke inhaled directly from a lit cigarette and sidestream smoke, which is smoke emitted from the smoldering tobacco between puffs and through the exhaled smoke emitted by a smoker, contain high concentrations of free radicals. Sidestream smoke affects both the smoker and the non-smokers around the smoker. A major health concern relates to the exposure of non-smokers, including infants and children, to tobacco smoke in the home and other locations that derives from smokers. Individuals who do not smoke but are exposed to secondary sidestream smoke may suffer the consequences of free radical damage from tobacco smoke.

Most of the free radicals in burning cigarette-produced smoke gas phase are instantaneous and unstable. It is impossible to observe them directly with Electron Spin Resonance Spectroscopy ("ESR spectroscopy") techniques. In order to observe gas phase free radicals, such as those present in cigarette smoke, a spin capture technique is employed. In this technique, gas phase free radicals are captured and then transformed into a spin adduct which can be tested via ESR spectroscopy. A spin collector (PBN) collects smoke gas phase free radicals, which are predominantly alkoxyl free radicals (RO.) and alkyl free radicals (R.).

Most of the gas phase free radicals in tobacco smoke are RO. and alkyl R. free radicals. Nitrogenous substances oxidize and produce great amounts of NO free radicals (NO.) in the process of cigarette burning. A reaction of NO. with oxygen results in the production of reactive $NO_2$. free radicals. A $NO_2$. free radical may react with olefin, a substance produced during cigarette burning, to form alkyl free radical RO. RO. free radicals may attack cell membranes and cause lipid peroxidation. In turn, such lipid peroxidation may stimulate macrophages to release oxygen free radicals. Oxygen free radicals, on their own, may independently cause injury to cell constituents. They may poison cells and may contribute to causing lung cancer and heart disease together with the free radicals present in the smoke of a lit cigarette. Such free radicals may also attack and, thereby inactivate pulmonary $\alpha$-1 antiprotease, which inhibits elastase and hence causes pulmonary injury.

Also, free radicals from cigarette smoke are considered in the pathogenesis of smoking-induced lung diseases, such as emphysema, lung cancer and heart diseases. Components of the lung matrix itself (e.g. collagen, elastin) can be damaged and fragmented by oxidants in cigarette smoke.

The damage of free radicals from cigarettes is not limited to the pulmonary tract. It was found that the urine of smokers contains 10 fold higher amounts of a typical biomarker of oxidative damage than the amounts shown in the urine of non-smokers. The noxious pro-oxidant effects of smoking may even extend beyond the epicardial arteries to coronary microcirculation and affect regulation of myocardial blood flow and cause carotid-media thickness.

One filter that claims to scavenge free radicals in cigarette smoke was pursued jointly by Biophysics Institute of Academica Sinica and Beijing Cigarette Factory in 1995. It uses tea polyphenol, vitamin C, and active carbon for a compound filter. This filter scavenges approximately 14% of gas phase free radicals caused by tobacco smoke. If additional ingredients, including ematin, rutin, catechin and neo-rutin are added to the tobacco in the cigarette, approximately an additional 12% of the gas phase free radicals may be scavenged. These additional ingredients, in combination, are referred to as "kendir" and "apocynum venetum L". Another cigarette filter that scavenges for free radicals was jointly invented by the Greece Golden Filter Company and Filter Development Company in 1999 (the "jointly developed filter"). This filter comprises active carbon and hemoglobin. It claims to scavenge about 90% gas phase free radicals found in tobacco smoke. Neither one of these two filters has gained commercial acceptance by cigarette manufacturers. There are two major reasons for the poor commercial acceptance of these filters. One is that the large dosages of additives in these filters reduce the original smoke flavor of the cigarette. This is a very significant disadvantage in the cigarette industry where cigarette taste and flavor is a key selling feature of recognized cigarette brands. Another factor is that the production of these complex filters requires a large investment in equipment modification which cigarette manufacturers are reluctant to invest. Another filter disclosed in U.S. Pat. No. 5,829,449 is directed to using L-glutathione and a source of selenium as the radical scavenger complex ingredient.

Accordingly, there is a need for: i) a cigarette filter with good scavenging effect on gas phase free radicals in cigarette smoke; ii) a cigarette filter that scavenges gas phase free radicals in cigarette filters and does not significantly alter or reduce the flavor and taste of the cigarette; and iii) a cigarette filter containing free radical scavengers that are optimally exposed to cigarette smoke in order to yield a maximum scavenging effect in a short period of time.

BRIEF SUMMARY OF THE INVENTION

One aspect of the invention resides in an improved cigarette filter with a scavenging effect on smoking induced gas phase free radicals which is achieved through the addition of an effective amount of a filtering ingredient or a mixture of the filtering ingredient and vitamin C and/or other ingredients known in the art having antioxidant filtering properties, but excluding a certain amount of L-glutathione. The filtering ingredient is selected from a group consisting of proanthocyanidins which may include procyanidins. These ingredients include extracts of barks of pine trees, extracts of cones of cypress trees, extracts of grape seeds and any combination thereof.

DETAILED DESCRIPTION OF THE INVENTION

Proanthocyanidins are highly potent free radical scavengers. In particular, proanthocyanidins represent a group of plant polyphenols found in fruits with an astringent taste and in barks. Proanthocyanidins may be extracted from plant material by conventional methods using water, ethanol or acetone/water mixtures as solvents and then concentrated through the processes of solvent evaporation, freeze-drying or spray-drying. Proanthocyanidins include procyanidins and prodelphinidins.

The proanthocyanidin used in the example below is Pycnogenol® pine bark extract which is produced and marketed by Horphag Research Limited. Pycnogenol® pine bark extract is derived from the bark of the French Maritime pine. It contains a range amount of approximately 70%–75% proanthocyanidins and other flavanols with free radical scavenging activity such as catechin, taxifolin and phenolic acids. The proanthocyanidins contained in this extract have a chain length of about 2 to 12 monomeric units, wherein the monomeric units consist of catechin or epicatechin. Other procyanidin-rich substances could also be used as free radical scavengers in cigarette filters. These substances include but are not limited to, extracts of the barks of pine trees, cones of cypress trees or grape seeds. Proanthocyanidins are particularly suitable for cigarette filters because they are non-volatile substances. Proanthocyanidins are biopolymers that possess a great tendency to stay adsorbed and remain inside the filter.

Free radical scavenging filters of the present invention may be prepared by evenly spraying a free radical scavenger solution completely over filter filaments, and then drying the filter elements and connecting the filter elements with cut unfiltered cigarettes and/or cigarette tobacco for forming into cigarettes. Prior to drying, the filter element may be shaped in a filter bundle shaping process.

Several examples of specific free radical solutions may be used. The examples and results are discussed below.

EXAMPLE 1

Dissolve proanthocyanidin and vitamin C (100%) in a proportion of 1:2 into a 95% ethanol solution. Evenly spray the ethanol solution containing the dissolved proanthocyanidin and vitamin C over cigarette filaments. Dry the sprayed filaments thereafter and process the dried filaments into cigarette filters as is well known in the art. Combine same with unfiltered cigarettes. The resulting proanthocyanidin and vitamin C content in such a cigarette filter of this example is respectively equal to about 0.00015% and 0.0003% of the cut tobacco of this cigarette in weight.

Testing for the effectiveness of the improved filter was performed in the following manner. Unfiltered cigarettes were used as reference cigarettes. ESR techniques were used to test the gas phase radicals respectively contained in the smoke of the cigarettes. The amount of free radicals in the filter of the present invention was compared with the amount in standard unfiltered cigarettes. Efficacy of the improved filter was conducted by using a smoking device to imitate human's smoking at a flow rate of about 400 ml/min, inhaling once for two seconds, one minute apart. The ESR testing conditions included: X band, 20 m W microwave power, 100 KHz modulation frequency and 1G modulation amplitude. See Table 1 for the test results. The free radical scavenging rate E was calculated by the following formula:

$$E=H_o\times 100/H_x$$

where $H_o$ represents the peak intensity of the reference system, and $H_x$ represents the peak intensity of scavenger containing samples. According to this formula, the gas phase free radical scavenging rate E was 24.3%.

EXAMPLE 2

Using the method of Example 1, cigarettes with the improved filter having a proanthocyanidin content of about 0.00015% (based on the weight of a single cigarette of cut tobacco) were tested in accordance with the procedure explained above and calculated by the above-mentioned free radical scavenging rate formula. The gas phase free radical scavenging rate was 22.6%. For the detailed results, see Table 2.

EXAMPLE 3

Using the method of Example 1, the cigarettes with the improved filter having a proanthocyanidin content of about 0.0003% (based on the weight of a single cigarette of cut tobacco) were tested in accordance with the procedure explained above and calculated by the above-mentioned free radical scavenging rate formula. Calculated by the above-mentioned free radical scavenging rate formula, the gas phase free radical scavenging rate was 27.6%. For the detailed results, see Table 3.

EXAMPLE 4

Using the method of Example 1, cigarettes with an improved filter having a proanthocyanidin content of about 0.0005% (based on the weight of a single cigarette of cut tobacco) were tested in accordance with the procedure explained above and calculated by the above-mentioned free radical scavenging rate formula. Calculated by the above-mentioned free radical scavenging rate formula, the gas phase free radical scavenging rate was 29.1%. For the detailed results, see Table 4. This test indicated that when the proanthocyanidin content in the filter is 0.0005%, the gas phase radical scavenging effect is at its maximum.

EXAMPLE 5

Using the method of Example 1, cigarettes with an improved filter having a proanthocyanidin content of about 0.001% (based on the weight of a single cigarette of cut tobacco) were tested in accordance with the procedure explained above and calculated by the above-mentioned free radical scavenging rate formula. Calculated by the above-mentioned free radical scavenging rate formula, the gas phase free radical scavenging rate was about 20%. For the detailed results, see Table 5. As shown by the above examples, when the proanthocyanidin content in the filter is within a range of about 0.00015% and 0.001% (based on the weight of a single cigarette of cut tobacco), a high scavenging effect on gas phase free radicals in smoke was achieved. Adding vitamin C into the filters further improved the free radical scavenging effects.

The reduction of free radicals in tobacco smoke also reduces the mutagenic action of tobacco smoke and markedly increases the life-time of animals exposed to filtered smoke. In one study, mice were exposed to lethal amounts of cigarette smoke in a polyacryl glass cabin (35.6×35×20 cm) with two 1.5 $cm^2$ holes, one located on top of the cabin for ventilation and another located at the bottom for introducing the gas phase. Forty (40) mice were randomly divided into 4 groups. Mice in group 1 were treated with smoke from cigarettes with standard filters. Mice in groups 2 and 3 were treated with smoke from cigarettes with filters containing 0.00015% mg and 0.0005% mg proanthocyanidin, pine bark extract respectively. Mice in group 4 served as control and were not treated with cigarette smoke. Cigarette smoke was introduced into a cabin containing one group of 10 mice at a time. The time and number of cigarettes used until the lethal endpoint was reached were recorded. The deceased mice were examined for histopathological changes.

All deceased mice were subject to biopsies and histopathological examination. In the control group (cigarette filters without proanthocyanidins) an obvious congestion and hemorrhage in lung tissue was observed in 80% of mice. Also, a vasodilation and congestion of small blood vessels in kidneys and slight vasodilation and congestion of central veins in livers were found. However, there were no visible abnormal changes in the heart and spleen.

The presence of 0.0005% proanthocyanidin pine bark extract in cigarette filters significantly increased the survival time and reduced the acute toxicity of cigarette smoke by 70.5%. In the absence of proanthocyanidins in the cigarette filters, the mice died after inhaling the smoke of 8 cigarettes, wherein the presence of 0.0005% mg proanthocyanidin pine bark extract in the filters, mice died after exposure to the smoke of 14 cigarettes.

Based on the above, the appropriate content of the above-mentioned free radical scavenger contained in a filter shall account for 0.0001%–0.001% of the cut tobacco in weight. The scavenger is more effective in this range. The proportion between the procyanidin content and the vitamin C content is equal to 0.5–1.5:1.5–2.5, and the most preferred is 1.0. In all the embodiments however, L-glutathione and a source of selenium selected from the group consisting of L-selenomethionine and L-selenocysteine are substantially or completely excluded from inclusion in the cigarette filter of the invention.

TABLE 1

0.00015% proanthocyanidin and 0.0003% Vc combining filter's scavenging effect on gas phase free radical in smoke

| $H_o$ of control Group | | | | $H_x$ of Application Example 1 | | | |
|---|---|---|---|---|---|---|---|
| 6.7 | 18.5 | 7.6 | 11.5 | 4.3 | 11.4 | 6.2 | 5.8 |
| 5.6 | 21.5 | 7.8 | 7.7 | 5.6 | 10.7 | 5.8 | 9.5 |
| 5.7 | 14.2 | 5.5 | 10.4 | 5.7 | 5.2 | 4.4 | 5.9 |
| 6.9 | 21.5 | 6.0 | 7.2 | 5.2 | 5.5 | 5.6 | 5.6 |
| 7.0 | 6.5 | 7.4 | 7.2 | 5.9 | 4.4 | 10.5 | 6.5 |
| 7.8 | 6.4 | 8.2 | 5.5 | 7.0 | 1.5 | 6.3 | 10.4 |
| 7.4 | 6.0 | 8.0 | 10.3 | 6.2 | 6.7 | 5.6 | 7.1 |
| 10.0 | 6.0 | 9.0 | 11.0 | 9.0 | 6.0 | 5.5 | 10.7 |
| 8.5 | 6.7 | 6.2 | 12.5 | 6.7 | 6.0 | 5.5 | 7.3 |
| 5.7 | 6.0 | 6.2 | 9.5 | 5.0 | 6.7 | 5.7 | 9.8 |

TABLE 1-continued 0.00015% proanthocyanidin and 0.0003% Vc combining filter's scavenging effect on gas phase free radical in smoke

| $H_o$ of control Group | | | | $H_x$ of Application Example 1 | | | |
|---|---|---|---|---|---|---|---|
| 6.7 | 7.4 | 6.0 | 12.6 | 6.3 | 5.6 | 9.0 | 7.0 |
| 6.8 | 7.8 | 9.2 | 9.4 | 5.2 | 7.0 | 10.0 | 8.0 |
| 7.4 | 8.0 | 9.5 | 8.7 | 7.4 | 6.0 | 8.0 | 6.0 |
| 8.0 | 16.0 | 8.0 | 9.8 | 4.6 | 5.5 | 6.8 | 8.5 |
| 7.1 | 16.0 | 5.3 | 6.8 | 5.0 | 6.5 | 7.5 | 7.2 |
| 6.6 | 17.0 | 7.3 | 9.0 | 5.2 | 11.8 | 7.0 | 6.8 |
| 8.9 | 11.8 | 8.3 | 9.6 | 8.3 | 11.8 | 9.1 | 7.5 |
| 9.0 | 8.0 | 10.3 | 8.9 | 8.2 | 6.0 | 6.4 | 7.0 |
| 11.5 | 9.0 | 8.1 | 8.5 | 8.0 | 4.0 | 6.0 | 6.1 |
| 17.0 | 6.2 | 9.0 | 8.8 | 10.0 | 5.0 | 4.5 | 6.2 |
| 7.8 | 6.0 | 7.5 | 9.7 | 8.4 | 6.2 | 7.0 | 6.7 |
| 6.3 | 9.0 | 6.5 | 9.5 | 6.6 | 6.1 | 8.3 | 7.0 |
| 8.8 | 9.2 | 11.4 | 8.9 | 8.8 | 11.8 | 9.8 | 7.1 |
| 12.8 | 8.7 | 8.5 | 9.8 | 10.5 | 8.7 | 6.7 | 7.2 |
| 7.7 | 8.5 | 8.7 | 9.7 | 7.8 | 4.3 | 5.6 | 6.0 |
| 5.7 | 6.9 | 7.0 | 7.8 | 5.2 | 5.9 | 7.0 | 5.2 |
| 7.4 | 10.0 | 8.5 | 9.8 | 9.0 | 6.7 | 5.0 | 6.2 |
| 6.7 | 6.8 | 7.4 | 8.0 | 5.2 | 7.4 | 4.6 | 6.3 |
| 7.1 | 6.6 | 8.9 | 9.0 | 5.2 | 8.3 | 8.2 | 5.0 |
| 11.5 | 17.0 | 7.8 | 10.5 | 10.0 | 8.4 | 4.1 | 3.5 |
| 11.9 | 12.0 | 10.8 | 9.8 | 7.5 | 3.5 | 4.1 | 4.2 |
| Mean value | | | 8.96 | | | | 6.73 |
| Standard error | | | 2.59 | | | | 1.81 |
| Scavenging effect | | | | | | | 24.3% |
| P | | | | | | | <0.01 |

TABLE 2

0.00015% proanthocyanidin combining filter's scavenging effect on gas phase free radical in smoke

| $H_o$ of Control Group | | | | $H_x$ of Application Example 2 | | | |
|---|---|---|---|---|---|---|---|
| 4.1 | 4.6 | 4.5 | 4.5 | 2.0 | 3.0 | 4.3 | 5.1 |
| 7.5 | 4.8 | 8.0 | 5.0 | 4.5 | 7.5 | 4.7 | 4.0 |
| 4.0 | 8.0 | 13.5 | 8.0 | 5.0 | 3.5 | 9.0 | 3.5 |
| 6.9 | 6.2 | 4.7 | 5.6 | 7.8 | 7.9 | 7.4 | 5.1 |
| 5.7 | 6.9 | 7.0 | 7.8 | 5.0 | 3.9 | 4.9 | 5.7 |
| 7.4 | 10.0 | 6.5 | 5.7 | 5.1 | 6.7 | 7.1 | 6.6 |
| 6.7 | 6.8 | 7.4 | 8.0 | 7.3 | 7.0 | 6.4 | 6.3 |
| 7.1 | 6.6 | 8.9 | 9.0 | 5.0 | 6.9 | 6.1 | 4.2 |
| 11.5 | 17.0 | 7.8 | 7.0 | 6.5 | 7.0 | 10.0 | 11.0 |
| 6.6 | 7.1 | 9.0 | 8.8 | 11.5 | 6.2 | 6.4 | 6.5 |
| 6.3 | 8.7 | 7.6 | 5.0 | 7.7 | 8.0 | 6.0 | 7.0 |
| 7.0 | 7.5 | 6.1 | 5.0 | 4.1 | 7.6 | 5.6 | 6.0 |
| 5.5 | 5.5 | 6.5 | 8.5 | 7.5 | 5.0 | 4.0 | 4.1 |
| 8.5 | 9.5 | 8.5 | 10 | 4.0 | 5.0 | 4.0 | 4.05 |
| 12 | 9.0 | 8.0 | 7.0 | 4.0 | 5.5 | 6.0 | 4.6 |
| 10 | 11.0 | 10.5 | 8.9 | 7.3 | 5.5 | 7.5 | 7.6 |
| 9.2 | 9.5 | 10.0 | 7.0 | 4.8 | 5.7 | 6.0 | 6.6 |
| 10.5 | 8.0 | | | 8.0 | 5.0 | 8.0 | |
| Mean value | | | 7.22 | | | | 5.97 |
| Standard error | | | 2.28 | | | | 1.90 |
| Scavenging effect | | | | | | | 22.6% |
| P | | | | | | | <0.05 |

TABLE 3

0.003% proanthocyanidin combining filter = s scavenging effect on gas phase free radical in smoke

| $H_o$ of Control Group | | | | $H_x$ of Application Example 3 | | | |
|---|---|---|---|---|---|---|---|
| 18.5 | 6.5 | 9.9 | 5.2 | 12.0 | 6.7 | 5.3 | 4.4 |
| 18.5 | 6.8 | 7.3 | 5.8 | 12.0 | 5.6 | 6.0 | 2.7 |
| 16.5 | 5.3 | 7.5 | 7.2 | 11.0 | 6.1 | 7.5 | 6.5 |
| 15.5 | 5.9 | 7.5 | 9.0 | 10.3 | 5.7 | 6.0 | 4.2 |
| 15.2 | 5.8 | 7.0 | 8.8 | 10.0 | 6.7 | 5.2 | 6.0 |
| 15.0 | 7.7 | 6.1 | 8.5 | 10.0 | 7.0 | 5.4 | 6.2 |

TABLE 3-continued

| 0.003% proanthocyanidin combining filter = s scavenging effect on gas phase free radical in smoke | | | | | | | |
|---|---|---|---|---|---|---|---|
| $H_o$ of Control Group | | | | $H_x$ of Application Example 3 | | | |
| 15.0 | 5.5 | 6.5 | 7.4 | 9.9 | 7.1 | 4.6 | 6.1 |
| 13.7 | 5.4 | 8.0 | 10.5 | 9.5 | 7.8 | 6.0 | 7.0 |
| 13.3 | 5.8 | 6.6 | 8.0 | 9.0 | 7.8 | 3.0 | 7.0 |
| 13.0 | 7.8 | 7.0 | 6.6 | 8.2 | 5.1 | 4.2 | 6.1 |
| 12.0 | 6.2 | 9.0 | 6.5 | 8.0 | 7.1 | 4.5 | 3.9 |
| 11.2 | 7.9 | 8.6 | 5.7 | 8.0 | 5.1 | 4.0 | 6.0 |
| 10.0 | 6.0 | 6.0 | 7.2 | 7.0 | 5.6 | 3.7 | 7.2 |
| 8.0 | 6.5 | 6.5 | 7.3 | 6.5 | 6.8 | 5.4 | 6.7 |
| 9.0 | 6.0 | 5.0 | 7.8 | 7.2 | 4.2 | 4.2 | 3.2 |
| 7.8 | 7.1 | 6.8 | 7.0 | 6.0 | 8.0 | 6.7 | 4.1 |
| 6.7 | 6.1 | 5.9 | 7.4 | 7.1 | 5.3 | 6.0 | 4.5 |
| 18.5 | 5.5 | 14.2 | 5.5 | 10.5 | 11.2 | 10.5 | 8.0 |
| 6.5 | 6.4 | 6.0 | 6.0 | 3.6 | 8.4 | 5.1 | 4.7 |
| 6.7 | 6.0 | 7.4 | 7.8 | 4.0 | 5.5 | 5.7 | 4.5 |
| 8.0 | 16.0 | 16.0 | 17.0 | 12.0 | 10.5 | 10.5 | 6.0 |
| 11.8 | 8.0 | 9.0 | 9.5 | 11.8 | 5.0 | 5.2 | 5.0 |
| 6.0 | 7.6 | 7.8 | 10.5 | 7.7 | 7.0 | 6.0 | 5.0 |
| 6.0 | 7.4 | 8.2 | 7.9 | 6.5 | 3.5 | 6.0 | 4.0 |
| 6.0 | 5.0 | 6.2 | 9.7 | 5.2 | 6.0 | 8.0 | 9.0 |
| 6.7 | 5.6 | 6.0 | 10.9 | 6.9 | 5.6 | 2.3 | 5.0 |
| 5.7 | 6.7 | 7.0 | 9.8 | 3.7 | 6.7 | 2.7 | 5.0 |
| 7.8 | 9.8 | 5.7 | 8.1 | 2.0 | 2.2 | 6.2 | 8.2 |
| 5.1 | 8.2 | 5.6 | 8.9 | 3.8 | 4.6 | 2.9 | 6.8 |
| 5.3 | 8.0 | 7.5 | 9.0 | 4.3 | 2.5 | 2.6 | 5.0 |
| 6.5 | 8.8 | 5.3 | 9.6 | 5.2 | 5.4 | 4.6 | 6.0 |
| 5.8 | 7.7 | 8.5 | 9.8 | 3.0 | 4.2 | 4.5 | 5.2 |
| 5.8 | 7.8 | 6.2 | 7.9 | 5.2 | 3.7 | 5.4 | 4.4 |
| 9.2 | 8.0 | 8.5 | 9.9 | 2.7 | 6.5 | 4.2 | 5.0 |
| 9.8 | 8.0 | 9.5 | 10.5 | 6.5 | 6.1 | 2.0 | 4.5 |
| Mean value | | | 8.30 | | | | 6.01 |
| Standard error | | | 2.92 | | | | 2.12 |
| Scavenging effect | | | | | | | 27.6% |
| P | | | | | | | <0.01 |

TABLE 4

| 0.0005% proanthocyanidin combining filter's scavenging effect on gas phase free radical in smoke | | | | | | | |
|---|---|---|---|---|---|---|---|
| $H_o$ of Control Group | | | | $H_x$ of Application Example 4 | | | |
| 7.9 | 15.0 | 5.8 | 6.7 | 5.4 | 2.0 | 6.2 | 6.5 |
| 8.7 | 18.0 | 5.9 | 6.0 | 5.8 | 10.5 | 7.0 | 6.8 |
| 9.7 | 15.0 | 6.2 | 7.4 | 4.9 | 11.0 | 6.2 | 7.0 |
| 7.0 | 19.0 | 6.1 | 7.8 | 7.0 | 6.6 | 5.0 | 7.0 |
| 8.6 | 16.5 | 5.0 | 8.0 | 8.0 | 10.3 | 3.5 | 3.9 |
| 8.8 | 7.3 | 6.3 | 16.0 | 8.0 | 7.0 | 6.6 | 2.5 |
| 9.4 | 8.0 | 5.2 | 16.0 | 8.7 | 6.0 | 4.1 | 8.5 |
| 10.1 | 12.0 | 7.1 | 17.0 | 6.7 | 8.6 | 2.6 | 4.1 |
| 7.0 | 11.2 | 7.5 | 11.8 | 8.7 | 9.6 | 2.6 | 4.8 |
| 7.5 | 13.0 | 7.6 | 8.0 | 6.5 | 5.8 | 1.2 | 5.2 |
| 8.7 | 13.3 | 6.5 | 9.0 | 5.6 | 1.8 | 1.9 | 5.5 |
| 9.6 | 11.2 | 6.9 | 6.2 | 6.7 | 11.0 | 5.9 | 5.0 |
| 6.1 | 18.5 | 6.8 | 6.0 | 7.6 | 10.7 | 4.6 | 6.1 |
| 5.9 | 15.2 | 5.9 | 7.6 | 5.5 | 9.8 | 4.0 | 10.0 |
| 6.6 | 15.5 | 6.2 | 7.8 | 5.5 | 9.7 | 4.7 | 7.4 |
| 6.2 | 10.0 | 18.5 | 5.5 | 6.0 | 10.0 | 5.4 | 10.0 |
| 6.3 | 13.7 | 21.5 | 6.0 | 5.0 | 9.0 | 3.0 | 8.0 |
| 7.4 | 7.2 | 14.2 | 7.4 | 6.7 | 6.7 | 6.2 | 5.0 |
| 9.1 | 6.2 | 6.5 | 8.2 | 6.6 | 5.0 | 6.4 | 8.0 |
| 6.4 | 6.0 | 6.6 | 6.0 | 7.1 | 5.8 | 5.6 | 9.8 |
| 5.0 | 6.2 | 6.2 | 6.9 | 8.8 | 3.0 | 4.4 | 4.5 |
| 9.2 | 9.5 | 6.0 | 8.2 | 5.7 | 5.8 | 5.7 | 8.5 |
| 10.3 | 8.1 | 9.0 | 7.5 | 7.7 | 9.5 | 7.5 | 8.2 |
| 7.2 | 6.2 | 5.8 | 5.9 | 5.0 | 6.2 | 7.0 | 6.2 |
| 8.2 | 8.1 | 5.0 | 8.3 | 5.0 | 3.5 | 6.6 | 4.1 |
| 5.3 | 7.7 | 7.5 | 7.6 | 2.6 | 2.6 | 1.2 | 1.9 |
| 8.5 | 8.9 | 6.8 | 4.7 | 5.9 | 4.6 | 4.0 | 4.7 |
| 5.9 | 6.2 | 7.9 | 8.0 | 5.4 | 3.0 | 5.4 | 5.8 |
| 9.7 | 7.0 | 8.6 | 8.0 | 4.9 | 7.0 | 6.0 | 6.0 |
| 8.8 | 8.2 | 10.1 | 7.0 | 6.2 | 6.7 | 6.7 | 6.7 |

TABLE 4-continued

| 0.0005% proanthocyanidin combining filter's scavenging effect on gas phase free radical in smoke | | | | | | | |
|---|---|---|---|---|---|---|---|
| $H_o$ of Control Group | | | | $H_x$ of Application Example 4 | | | |
| 7.5 | 8.7 | 9.6 | 6.1 | 6.5 | 5.6 | 6.7 | 7.6 |
| 5.9 | 8.6 | 6.2 | 6.3 | 5.5 | 5.5 | 6.0 | 5.0 |
| 7.4 | 9.1 | | | 6.7 | 6.6 | | |
| Mean value | | | 8.62 | | | | 6.11 |
| Standard error | | | 3.39 | | | | 2.17 |
| Scavenging effect | | | | | | | 29.1% |
| P | | | | | | | <0.01 |

TABLE 5

| 0.001% proanthocyanidin combining filter = s scavenging effect on gas phase free radical in smoke | | | | | | | |
|---|---|---|---|---|---|---|---|
| $H_o$ of control Group | | | | $H_x$ of Application Example 5 | | | |
| 6.6 | 8.5 | 7.8 | 6.6 | 1.2 | 6.5 | 5.8 | 1.2 |
| 6.6 | 6.0 | 8.0 | 5.6 | 5.8 | 6.0 | 11.1 | 5.9 |
| 8.6 | 5.4 | 16.0 | 8.6 | 4.0 | 4.8 | 12.0 | 4.0 |
| 6.9 | 6.1 | 16.0 | 5.9 | 4.9 | 7.2 | 11.8 | 4.9 |
| 5.8 | 6.1 | 17.0 | 5.3 | 5.2 | 6.2 | 11.0 | 5.2 |
| 6.4 | 7.8 | 11.8 | 6.4 | 4.5 | 6.6 | 12.5 | 4.5 |
| 7.1 | 7.8 | 8.0 | 5.1 | 8.0 | 5.7 | 9.0 | 6.0 |
| 8.2 | 5.7 | 9.0 | 8.2 | 6.2 | 4.7 | 6.7 | 6.2 |
| 6.3 | 6.0 | 6.2 | 6.3 | 5.9 | 5.0 | 5.2 | 5.9 |
| 6.7 | 8.5 | 6.0 | 8.1 | 5.2 | 6.0 | 7.0 | 5.2 |
| 5.7 | 8.0 | 7.6 | 5.2 | 5.2 | 6.0 | 7.0 | 5.3 |
| 6.9 | 5.3 | 7.8 | 6.9 | 5.1 | 6.3 | 6.5 | 5.1 |
| 6.2 | 5.8 | 5.5 | 6.2 | 5.1 | 2.7 | 4.0 | 5.1 |
| 7.8 | 7.1 | 6.0 | 8.8 | 6.0 | 6.0 | 8.0 | 6.0 |
| 6.8 | 7.2 | 7.4 | 8.8 | 4.0 | 6.9 | 5.0 | 4.0 |
| 5.8 | 5.9 | 8.2 | 8.6 | 5.6 | 2.9 | 5.4 | 5.6 |
| 6.7 | 6.5 | 6.0 | 8.1 | 4.1 | 7.0 | 5.5 | 4.1 |
| 5.7 | 8.1 | 5.0 | 5.2 | 4.7 | 5.8 | 5.0 | 4.7 |
| 5.6 | 5.0 | 6.2 | 5.0 | 5.0 | 6.0 | 4.3 | 5.2 |
| 5.9 | 6.5 | 6.2 | 6.7 | 5.2 | 4.3 | 5.0 | 5.2 |
| 5.9 | 6.0 | 6.0 | 5.4 | 5.6 | 5.7 | 9.5 | 5.1 |
| 7.2 | 6.5 | 9.2 | 5.7 | 4.3 | 5.0 | 10.7 | 5.1 |
| 7.5 | 6.7 | 9.5 | 5.6 | 4.9 | 6.6 | 9.5 | 4.4 |
| 6.5 | 18.5 | 6.0 | 5.9 | 4.9 | 12.5 | 7.5 | 5.0 |
| 6.7 | 21.5 | 5.3 | 7.2 | 6.1 | 10.7 | 8.2 | 5.2 |
| 7.3 | 14.2 | 7.3 | 7.5 | 5.8 | 11.5 | 8.0 | 5.6 |
| 7.6 | 21.5 | 8.2 | 6.5 | 7.7 | 8.7 | 6.0 | 4.3 |
| 5.8 | 6.5 | 10.3 | 6.7 | 6.1 | 4.8 | 6.4 | 4.9 |
| 6.4 | 6.4 | 8.1 | 7.3 | 5.6 | 2.0 | 4.9 | 6.0 |
| 6.6 | 6.0 | 9.0 | 7.6 | 4.9 | 6.0 | 5.8 | 5.6 |
| 6.3 | 6.0 | 7.4 | 7.8 | 6.5 | 5.6 | 7.1 | 6.1 |
| 7.3 | 6.7 | 6.7 | 7.8 | 7.1 | 4.0 | 5.6 | 4.9 |
| 7.8 | 6.0 | 6.0 | 8.5 | 7.1 | 6.0 | 3.5 | 6.0 |
| Mean value | | | 7.45 | | | | 5.96 |
| Standard error | | | 2.79 | | | | 2.02 |
| Scavenging effect | | | | | | | 20.0% |
| P | | | | | | | <0.05 |

We claim:

1. A cigarette filter, comprising a filter element that includes procyanidins as filtering ingredients, the filtering ingredients being in an amount effective for scavenging gas phase free radicals present in cigarette smoke while not significantly altering favor and taste of the cigarette and wherein said filter is substantially free of L-glutathione.

2. A cigarette filter of claim 1 in combination with a remainder of the cigarette, wherein the amount of the filtering ingredients is within a range of about 0.0001% to about 0.001% of a weight of cut tobacco within the remainder of the cigarette.

3. A cigarette filter that is substantially free of L-glutathione in combination with a remainder of the cigarette, comprising filtering ingredients that include procyanidins, an amount of the filtering ingredients being within a range of about 0.0001% to about 0.001% of a weight of cut tobacco within the remainder of the cigarette.

4. A cigarette filter of claim 2, 1 or 3, wherein the filtering element further comprises vitamin C.

5. A cigarette filter of claim 4, wherein the amount of the procyanidins and the amount of vitamin C are in a ratio of about 0.5–1.5:1.5–2.5.

6. A method of producing a cigarette filter element substantially free of L-glutathione, comprising providing a filter element the includes procyanidins as filtering ingredients, the filtering ingredients being in an amount effective for scavenging gas phase free radicals present in cigarette smoke while not significantly altering flavor and taste of the cigarette.

7. The method of claim 6 in combination with a remainder of the cigarette, the amount of the filtering ingredients being within a range of from about 0.0001% to 0.001% of a weight of cut tobacco within the remainder of the cigarette.

8. A method of producing a cigarette including a cigarette filter and a remainder of a cigarette comprising providing a filter element which is substantially free of L-glutathione with procyanidins as filtering ingredients in an amount effective for scavenging gas phase free radicals in cigarette smoke, wherein the amount of the filtering ingredients is within a range of about 0.0001% to about 0.001% of weight of cut tobacco within the remainder of the cigarette.

9. The method of claim 6, 7 or 8, wherein the filtering ingredients include vitamin C.

10. The method of claim 9, wherein the amount of the procyanidins and the amount of vitamin C are in a ratio of about 0.5–1.5:1.5–2.5.

11. A method of claim 6, 7, or 8, wherein the step of providing includes:

(a) dissolving a defined amount of the filtering ingredients in solution of about 95% ethanol;

(b) spraying the solution of step (a): substantially evenly over the filter element; and (c) drying the filter element of step (b).

12. The method of claim 11, wherein the step of dissolving includes dissolving vitamin C into the solution.

13. The method of claim 8, further comprising the step of attaching the filter element to the cigarette.

14. The method of claim 13, further comprising fusing the filter element to the cigarette.

* * * * *